US005887068A

United States Patent [19]

Givogue et al.

[11] Patent Number: 5,887,068

[45] Date of Patent: Mar. 23, 1999

[54] MULTI-DRIVER IN-PHASE BIPOLAR ARRAY LOUDSPEAKER

[75] Inventors: Don E. Givogue, Buckingham; Robert G. Johnston, Almonte, both of Canada

[73] Assignee: Definitive Technology, Inc., Buckingham, Canada

[21] Appl. No.: 583,504

[22] Filed: Jan. 5, 1996

[51] Int. Cl.[6] ..... H04R 1/02

[52] U.S. Cl. ..... 381/89; 381/99

[58] Field of Search ..... 381/97, 89, 90, 381/188, 205, 24, 182, 98, 99, 96; 181/144, 145

[56] References Cited

U.S. PATENT DOCUMENTS

| | | | |
|---|---|---|---|
| 3,016,424 | 1/1962 | Franke | 381/99 |
| 3,814,857 | 6/1974 | Thomasen | 381/99 |
| 4,862,508 | 8/1989 | Lemon | 381/182 |
| 4,884,655 | 12/1989 | Freadman et al. . | |
| 4,940,108 | 7/1990 | Selby . | |
| 4,942,939 | 7/1990 | Harrison . | |
| 4,998,283 | 3/1991 | Nishida et al. . | |
| 5,000,286 | 3/1991 | Crawford et al. . | |
| 5,033,577 | 7/1991 | Veranth . | |
| 5,170,436 | 12/1992 | Powell . | |
| 5,187,333 | 2/1993 | Adair . | |
| 5,216,210 | 6/1993 | Kammer . | |
| 5,222,145 | 6/1993 | Draffen . | |
| 5,274,709 | 12/1993 | Koizumi | 381/24 |
| 5,321,756 | 6/1994 | Patterson, Jr. et al. | 381/89 |
| 5,374,124 | 12/1994 | Edwards . | |

FOREIGN PATENT DOCUMENTS

| | | | |
|---|---|---|---|
| 3130234 | 2/1983 | Germany | 381/24 |
| 104498 | 5/1991 | Japan | 381/24 |

*Primary Examiner*—Vivian Chang

*Attorney, Agent, or Firm*—Paul C. Remus, Esq.; Kristin Kohler, Esq.; Devine, Millimet & Branch, P.A.

[57] ABSTRACT

This loudspeaker system overcomes the disadvantages of prior art bipolar loudspeaker systems in which the front and rear-mounted driver(s) are connected with the same electrical phase. It compensates for the undesirable cancellation and reinforcement effects of prior art in bipolar loudspeaker design caused by the interaction of the front and rear acoustical output of the two drivers over certain frequency ranges. The introduction of a third side-mounted driver(s) to an enclosure whose depth exceeds its width when viewed from the front compensates for the usual cancellations and reinforcements of acoustic level that would normally occur in previous bipolar loudspeaker designs. This loudspeaker uses electronic, electrical and acoustical frequency-dividing networks to allow compensation of the acoustic level and the interaction of the front, rear and side-mounted driver(s) in such a way as to provide a nearly constant acoustic level over the entire operating range of the loudspeaker. The arrangement of the three drivers and their associated electronic, electrical and acoustical frequency-dividing networks allows the attainment of a loudspeaker with a bipolar radiating characteristic that does not possess the previously unavoidable peaks and dips in acoustical output caused by reinforcement and cancellation of the acoustic outputs from the front and rear-mounted driver(s). In this loudspeaker, the low-frequency range is covered by the side-mounted driver (s) and the upper frequency range is covered by the front and rear-mounted driver(s).

13 Claims, 4 Drawing Sheets

MULTI-DRIVER IN-PHASE BIPOLAR ARRAY LOUDSPEAKER

BACKGROUND OF THE INVENTION

The invention pertains to loudspeakers that are well suited for use in high-fidelity audio systems and more particularly for use in high quality home theater systems. Specifically, the invention pertains to loudspeakers that have the characteristics of both in-phase bipolar acoustical radiation and an essentially constant acoustical output over the entire operating range of the loudspeaker.

DESCRIPTION OF THE PRIOR ART

Audio loudspeakers are widely known and range in quality and acoustical performance from extremely poor to rather excellent. It is high performance bipolar loudspeaker systems to which this invention is directed. Bipolar speakers comprise multiple audio drivers mounted in a single enclosure in such a manner so that the drivers face in opposite directions, generally refered to as the front and rear directions. In prior art bipolar loudspeaker systems, an example of which is shown in FIGS. 1 and 2, interference in acoustical output between the front and the rear-mounted drivers F and R, respectively of an in-phase bipolar loudspeaker system produces areas of cancellation of acoustic output such that acoustic output would drop to a low level at certain frequencies, and areas of reinforcement of acoustic output of the front and rear-mounted drivers such that the acoustic output would rise to a high level at certain frequencies. These areas of cancellation produce a characteristic unevenness in the acoustical output over the operating frequency range of such prior art, in-phase, bipolar loudspeakers. The resultant acoustical output as a function of frequency is shown in FIG. 3. As can be seen, the frequencies at which cancellation and reinforcement of acoustical /output of the front and rear-mounted drivers appear as peaks P and valleys V in the graph of acoustical output level vs. ouput frequency.

Previous attempts to reduce or eliminate these interferences have not been wholly successful nor satisfactory in their implementation. For example, prior art bipolar loudspeakers have used extremely wide front baffles in an attempt to minimize the interaction of the acoustical output of the front and rear drivers. This physical arrangement, although somewhat effective, produces an extremely visually unappealing loudspeaker, as the wide front baffle is too large to be practical in a home setting.

Other attempts at overcoming the interaction of the acoustical output of the front and rear drivers F and R have involved the limiting of the range of frequencies over which the front and rear drivers act in common. Although this approach is effective in reducing the interaction of the acoustical output of the front and rear drivers, it does not produce a fully bipolar loudspeaker, as the frequency range of bipolar operation of the loudspeaker is a subset of the entire operating frequency range of the bipolar loudspeaker.

SUMMARY OF INVENTION

In accordance with the teachings of this invention, a multi-driver in-phase bipolar loudspeaker system is provided that overcomes many of the disadvantages of prior art systems. In order to correct for the undesirable reinforcement and cancellation in acoustical output that occurs over certain frequency ranges in prior art bipolar loudspeakers, a preferred embodiment of the disclosed invention provides for at least one side-mounted driver to be mounted intermediate front and rear-mounted driver(s) in a single speaker enclosure. In this preferred embodiment, which utilizes a rectangular driver enclosure, the side-mounted driver is oriented substantially perpendicular to the front and rear-mounted drivers. This corrects the undesirable reinforcement and cancellation in acoustical output that occurs over certain frequency ranges more fully than would be possible in prior art loudspeakers.

DETAILED DESCRIPTION OF THE INVENTION

Figure 4A:
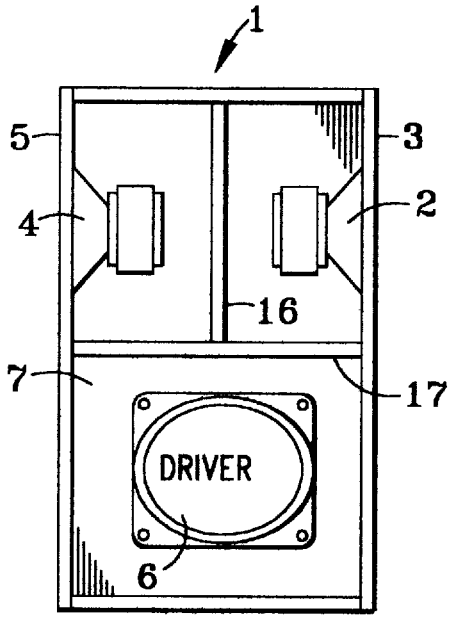
FIG. 4*a* is a side view of one embodiment of the applicant's invention showing one means of providing separation of the front, rear and side-mounted driver(s) comprising internal cabinet partitions.

Referring now to the FIGS. 4*a,* 4*b,* 5, and 6, a preferred embodiment of the disclosed multi-driver in-phase bipolar array loudspeaker system is shown and comprises a speaker enclosure generally designated by the reference numeral 1. In this embodiment, a front driver 2 is mounted on a front-facing baffle 3. Front-mounted driver 2 may comprise of a single physical audio driver unit or a plurality of individual physical driver units whose purpose is to cover the full operating frequency range of a single individual front driver unit 2 mounted on the front baffle 3. The nature of the embodiment of the invention is not changed by the number of front drivers 2 mounted on the front baffle 3 to cover the fill operating frequency range intended for the front baffle driver or drivers 2. The same can also be said for the rear driver or drivers 4 mounted on a rear-facing baffle 5, which are selected to cover the full operating frequency range intended for the rear driver mounted on the rear baffle 5. The same is also true for the side driver or drivers 6, which are mounted on a side-facing baffle 7, which are selected to cover the full operating frequency range intended for the driver mounted on the side baffle 7. Therefore in the text of this disclosure, the word "driver(s)" is intended to convey that a single physical unit or multiple units may be used as desired on the front baffle 3, rear baffle 5 or side baffle 7 to cover the front, rear or side baffle's intended operating frequency range.

Figure 6:
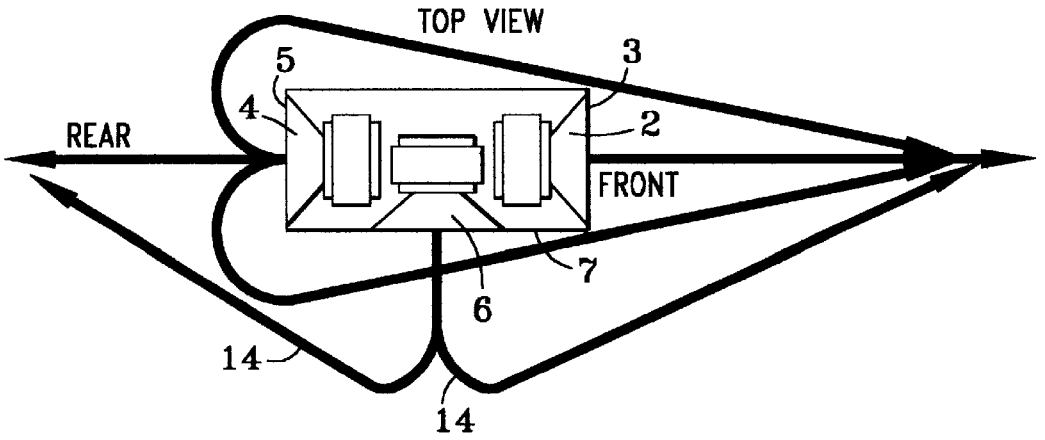
FIG. 6 is a diagram showing the direction of the acoustical output from the front, rear and side-mounted driver(s).

In accordance with the teaching of this invention, a multi-driver in-phase bipolar array loudspeaker system 1 is taught which includes a plurality of audio drivers 2, 4, and 6, including one or more audio drivers specifically dedicated for the purpose of compensating for the cancellation and reinforcement effects of the front and rear-mounted driver(s) 2 and 4. In a preferred embodiment, a minimum of three physical driver units are required: a front driver 2 mounted on the front baffle 3; a second, rear driver 4 on the rear baffle 5; and a third, side driver 6 mounted on the side baffle 7. As shown in FIG. 6, side baffle 7 is substantially wider than either the front baffle 3 or the rear baffle 5, which are preferrably substantially the same width.

Figure 5:
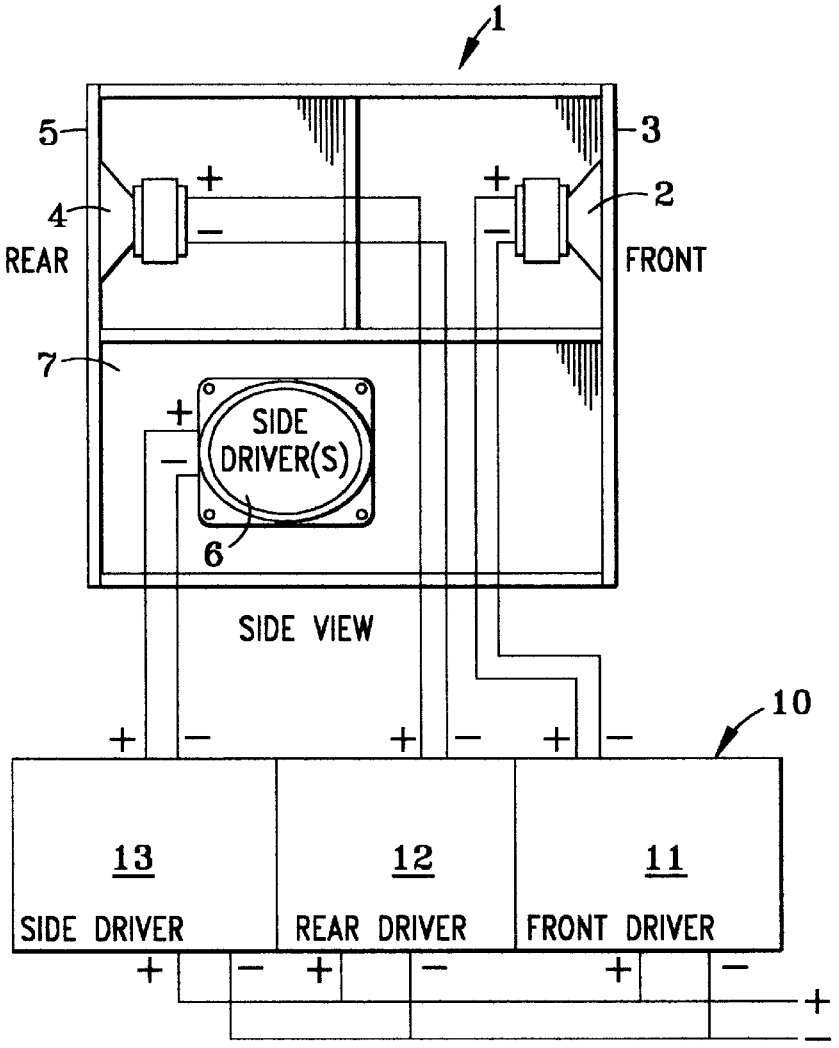
FIG. 5 is a schematic representation of the frequency dividing networks for the front, rear and side-mounted driver(s).
Figure 7:
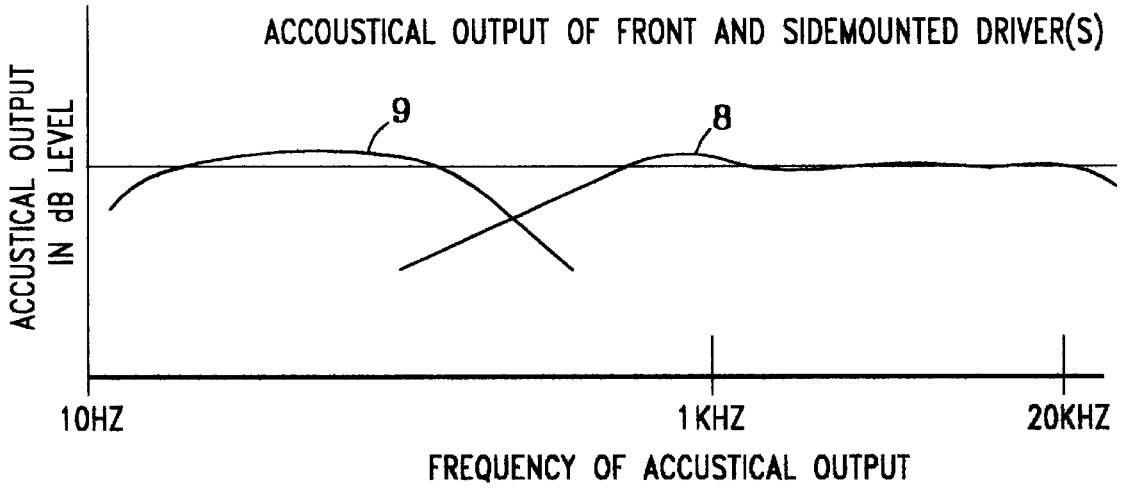
FIG. 7 is a graph depicting the acoustical output level vs frequency of the front, rear and side-mounted driver(s).

As is indicated in the graph of acoustical output versus frequency, shown in FIG. 7, the front and rear-mounted driver(s) 2 and 4 cover a first frequency range 8 that is a higher frequency range than a second frequency range 9, which is covered by the side-mounted driver(s) 6. When FIG. 5 is viewed in combination with FIG. 7, a frequency dividing network 10 is shown, which is used to limit the frequency ranges of the front, rear and side-mounted drivers. The frequency dividing network 10 may be electronic, electrical, acoustical or a combination of the above. The frequency dividing network comprises front and rear-mounted driver networks 11 and 12, which control the first frequency range 8 of the front and rear-mounted driver(s) 2 and 4 and side-mounted driver network 13, which controls the second frequency range 9 of the side-mounted driver(s) 6. Driver networks 11, 12 and 13 operate in unison to ensure that the first frequency range 8 is limited to a range that is higher than the second frequency range 9.

Figure 1:
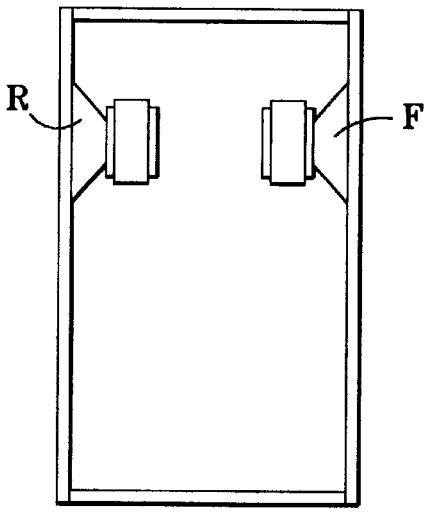
FIG. 1 PRIOR ART
FIG. 1 is a side view of the mounting of the front and rear-mounted driver(s) of a typical prior art bipolar loudspeaker.
Figure 2:
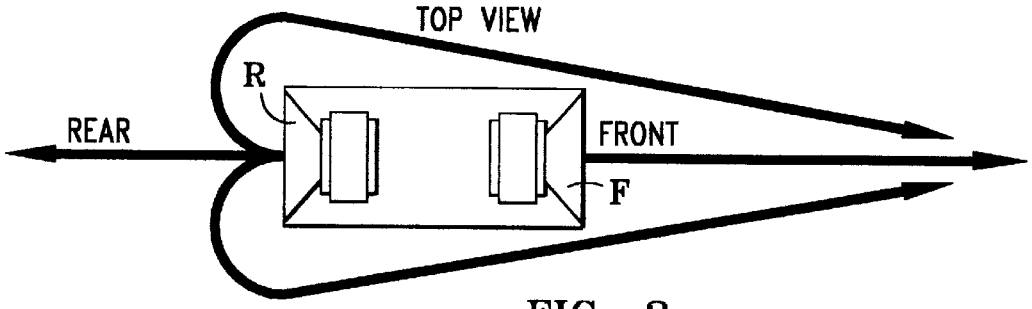
FIG. 2 PRIOR ART
FIG. 2 is a diagram of the direction of the acoustical output from the front and rear-mounted driver(s) of a typical prior art bipolar loudspeaker.
Figure 3:
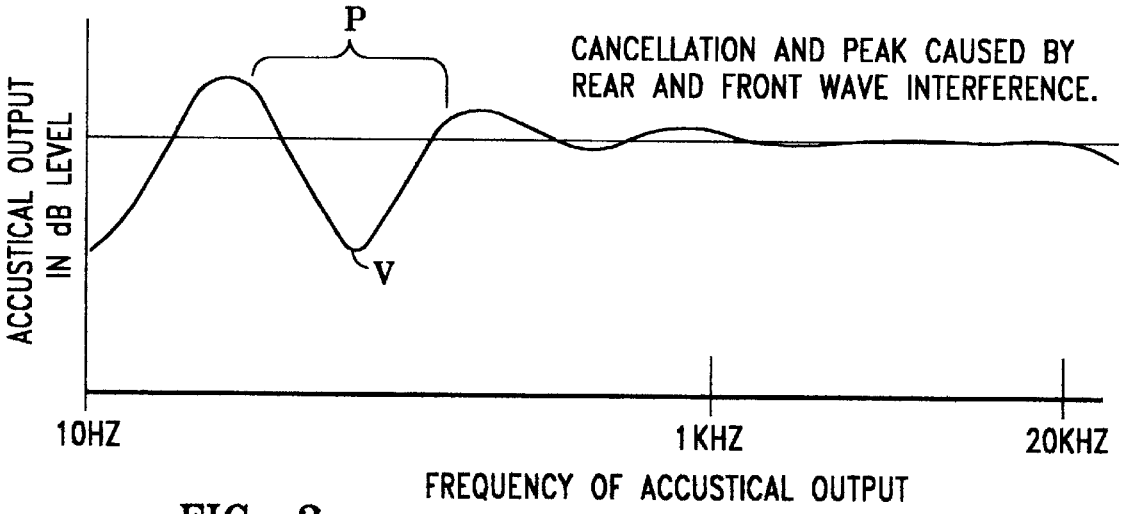
FIG. 3 PRIOR ART
FIG. 3 is a graph of acoustical output level vs frequency which shows the typical effects of cancellation and reinforcement of rear and front wave interference demonstrated by prior art bipolar loudspeakers.

As can be seen in FIG. 3, at certain, relatively low frequency ranges, the acoustical outputs of the front and rear-mounted driver(s) of prior art bipolar speakers can interact and cause severe cancellation and peaks caused by sound wave interferences. In order to limit such cancellations and peaks, the frequency dividing network 10 of the applicant's multi-driver in-phase bipolar array loudspeaker system controls the front and rear driver(s)' acoustical output frequency range 8 to be in a range substantially above the range where such severe cancellation and peaks occur. This prevents the normal peaks and dips in acoustical output that would accompany a conventional bipolar loudspeaker.

Figure 8:
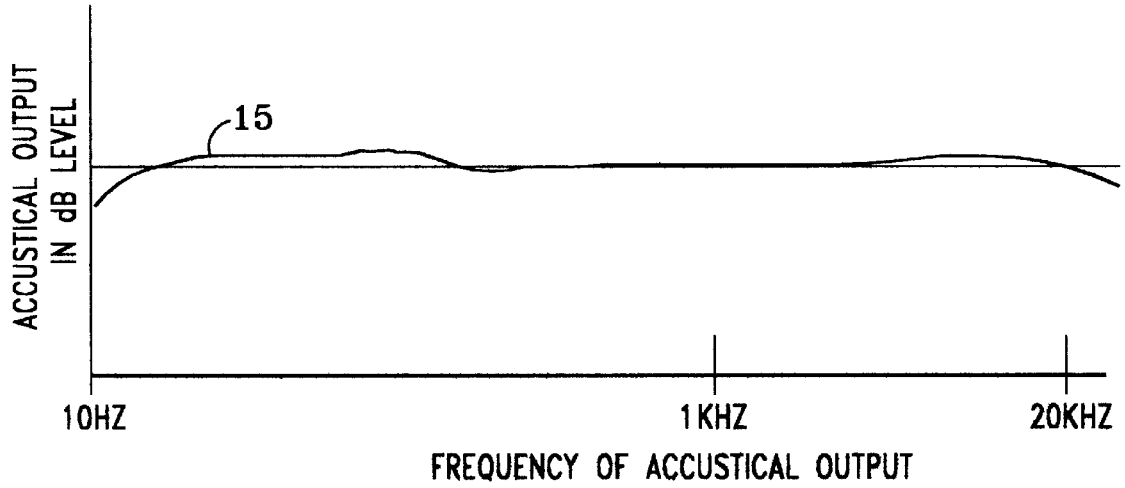
FIG. 8 is a graph showing the essentially constant acoustical output level vs frequency obtained from the applicant's multi-driver in-phase bipolar loudspeaker system.

The second operating frequency range 9, which is occupied by the output of the side-mounted driver(s) 6 is controlled by driver network 13 to fall within a frequency range substantially below that where the directionality of the sound coming from the side-mounted driver(s) 6 has any significance. As shown in FIG. 6, this allows the acoustic output radiating from the side-mounted driver(s) 14 to propagate equally from the loudspeaker system in both the forward and rearward directions. As can be seen in the graph of the acoustical output level vs. frequency obtained from the applicant's multi-driver in-phase bipolar array loudspeaker shown in FIG. 8, since the side driver(s) 6 is mounted between the front and rear-mounted driver(s) 2 and 4 and is a single source of acoustical output through the frequency range where cancellations and peaks would occur if using only two acoustical sources, the cancellations and peaks normally associated with prior art in bipolar loudspeakers are eliminated. Additionally, the nature and makeup of the frequency dividing networks 10, 11, and 12 are such as to ensure that an essentially constant acoustic output 15 is obtained from the applicant's multi-driver in-phase bipolar array loudspeaker when measured in an anechoic or semi-anechoic environment relative to the front baffle of the loudspeaker.

Figure 4B:
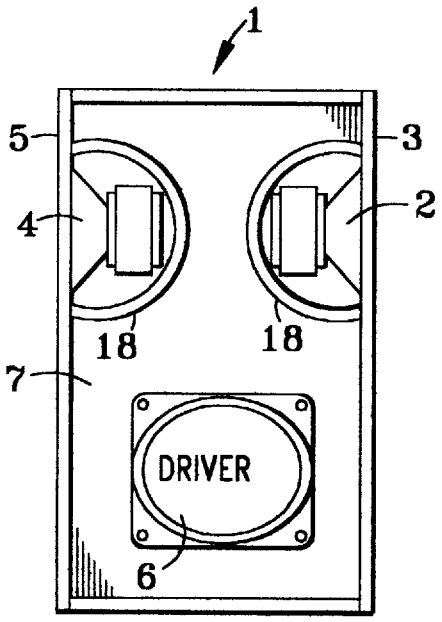
FIG. 4*b* is a side view of a second embodiment of the applicant's invention showing a means of providing separation of the front, rear and side-mounted driver(s) integrated into the front and rear-mounted driver(s) (bottom).

Internal separation of the front, rear and side-mounted driver(s) 2, 4, and 6 internally in the enclosure 1 is required to prevent internal interaction of their acoustical outputs. This can be achieved in any number of ways. In a first embodiment, separation is accomplished through the introduction of internal cabinet partitions 16 and 17, as shown in FIG. 4*a*. At a minimum, a single internal partitioning method must be used to separate the side-mounted driver(s) 6 from the front and rear-mounted driver(s) 2 and 4. This partitioning method may be a characteristic of the internal cabinet partitioning 17 or integrated into acoustical insulating backplates 18 in front and rear-mounted driver(s) 2 and 4, as shown in FIG. 4*b*.

In the preferred embodiment, the front, rear and side-mounted driver(s) 2, 4 and 6 are all connected electrically in phase throughout the lower and mid frequency range of operation. The phase relationship of the front and rear-mounted driver(s) 2 and 4 is also the same at high frequencies. However, the relationship at high frequencies of electrical phase of the front and rear-mounted driver(s) 2 and 4 may or may not be the same as the side-mounted driver(s) 6. The electrical phase of the side-mounted driver(s) 6 to the front and rear-mounted driver(s) 2 and 4 is of interest only in the middle and lower operating frequency range as this is an intermediate range of common frequency coverage, shared by the front, rear and side-mounted driver(s) 2, 4 and 6.

In the disclosed invention, the acoustical output from the front, rear and side-mounted driver(s) will emanate from the enclosure 1 in an approximately equally manner over the full operating frequency range of the loudspeaker when measured from the perspective of the front baffle 3. The various acoustical outputs will sum in the listening environment producing a nearly constant acoustical output level 15 over the entire operating frequency range of the loudspeaker.

What is claimed is:

1. A multi-driver in-phase loudspeaker system comprising at least three speaker drivers mounted in a unitary enclosure, said drivers comprising at least one front-facing driver mounted on a front baffle of said enclosure, at least one rear-facing driver, mounted on a rear baffle of said enclosure, said rear baffle oriented substantially opposite said front baffle, and at least one side-facing driver mounted on a side baffle of said enclosure, a frequency dividing network comprising a front and rear-mounted driver network, which controls a first frequency range at which said front and rear-mounted drivers operate and a side-mounted driver network, which controls a second frequency range at which said side-mounted driver operates, wherein said first frequency range is higher than said second frequency range and overlapping said second frequency range in an intermediate range of common, frequency coverage, and a means for completely acoustically separating said front rear and side-mounted drivers within said enclosure to prevent internal interaction of the driver's acoustical outputs.

2. The multi-driver in-phase loudspeaker system of claim 1, wherein said means for completely acoustically separating comprises at least one soundwave-impermeable internal cabinet partition completely separating said front and rear-mounted drivers from said side-mounted driver.

3. The multi-driver in-phase loudspeaker system of claim 2, wherein said means for completely acoustically separating comprises soundwave-impermeable internal cabinet partitions separating said front, rear and side-mounted drivers from each other.

4. The multi-driver in-phase loudspeaker system of claim 1, wherein said acoustical separation means comprises acoustical insulating backplates included with said front and rear-mounted drivers to completely separate said front and rear-mounted drivers from said side-mounted driver.

5. The multi-driver in-phase loudspeaker system of claim 1, wherein all of said drivers included in said system are connected in the same electrical phase relationship with respect to each other in an intermediate range of common frequency coverage.

6. The multi-driver, in-phase loudspeaker system of claim 1, wherein said frequency dividing network is an electronic network.

7. The multi-driver, in-phase loudspeaker system of claim 1, wherein said frequency dividing network is an electrical network.

8. The multi-driver, in-phase loudspeaker system of claim 1, wherein said frequency dividing network is an acoustical network.

9. The multi-driver in-phase loudspeaker system of claim 1, wherein said frequency dividing network is a combination of electronic, electrical, or acoustical networks.

10. The multi-driver in-phase loudspeaker system of claim 1, wherein said front and rear baffles have a first width and said side baffle has a second width, said second width being substantially wider than said first width.

11. The multi-driver in-phase loudspeaker system of claim 1, wherein a combined acoustical output of said front, rear and side-mounted drivers, when measured on axis from the perspective of said front-mounted driver(s) in an anechoic or semi-anechoic environment, will produce an acoustical output level that is substantially constant in nature over the entire operating range of frequencies for which said loudspeaker system is utilized.

12. The multi-driver in-phase loudspeaker system of claim 1, wherein said second frequency range is substantially below a range where directionality of sound coming from said side-mounted driver has any significance.

13. The multi-driver in-phase loudspeaker system of claim 1, wherein said front and rear-mounted drivers are connected in the same electrical phase relationship with respect to each other.

* * * * *